United States Patent [19]

Patel

[11] Patent Number: 4,551,970

[45] Date of Patent: Nov. 12, 1985

[54] APPARATUS FOR THE FALSE TWISTING OF THREADS USING FRICTION DISKS

[75] Inventor: Kirit Patel, Elfershausen, Fed. Rep. of Germany

[73] Assignee: FAG Kugelfischer Georg Schafer (KGaA), Fed. Rep. of Germany

[21] Appl. No.: 620,151

[22] Filed: Jun. 13, 1984

[30] Foreign Application Priority Data

Jun. 30, 1983 [DE] Fed. Rep. of Germany ..... 3323543

[51] Int. Cl.[4] ..... D01H 7/92; D02G 1/04

[52] U.S. Cl. ..... 57/339; 57/338; 57/340

[58] Field of Search ..... 57/337, 338, 339, 340

[56] References Cited

U.S. PATENT DOCUMENTS

| | | | |
|---|---|---|---|
| 3,762,149 | 10/1973 | Raschle | 57/339 |
| 3,932,985 | 1/1976 | Naylor | 57/339 |
| 3,955,350 | 5/1976 | Schuster | 57/340 X |
| 4,134,252 | 1/1979 | Otaki et al. | 57/339 X |
| 4,218,870 | 8/1980 | King | 57/339 X |
| 4,333,308 | 6/1982 | Schleyer | 57/339 |

FOREIGN PATENT DOCUMENTS

| | | |
|---|---|---|
| 2527216 | 6/1975 | Fed. Rep. of Germany . |
| 2658034 | 12/1976 | Fed. Rep. of Germany . |

OTHER PUBLICATIONS

Conversion Instruction, FAG Nickel-Diamond or Polyurethane Friction, Single Discs on SCRAG-G-Positorq Unit MK 1, DB 849-E.

*Primary Examiner*—Donald Watkins

*Attorney, Agent, or Firm*—Ostrolenk, Faber, Gerb & Soffen

[57] ABSTRACT

A disk combination which permits a thread false-twisting device to be operated at a high withdrawal speed is disclosed. The false-twisting device has three parallel rotatable shafts. On a first shaft is a first inlet guide disk for guiding entering thread into a thread path. A second inlet guide disk on a second shaft guides the thread along the path. After the second inlet guide disk, a first working disk on the first shaft begins false-twisting the thread. The first working disk may be one of five working disks, each of which is positioned in the rotational direction from the preceding disk. After the last of the working disks the exiting thread contacts an outlet guide disk, also positioned in the rotational direction from the preceding disk. The disks may be made of a soft material, such as polyurethane, or may be rigid disks coated with a hard material such as nickel containing diamond particles. The thread can be drawn through the device at a speed in excess of 600 meters per minute.

13 Claims, 11 Drawing Figures

3-5-1

2-5-1

1-5-1

3-5-1

2-5-1

1-5-1

Fig.7
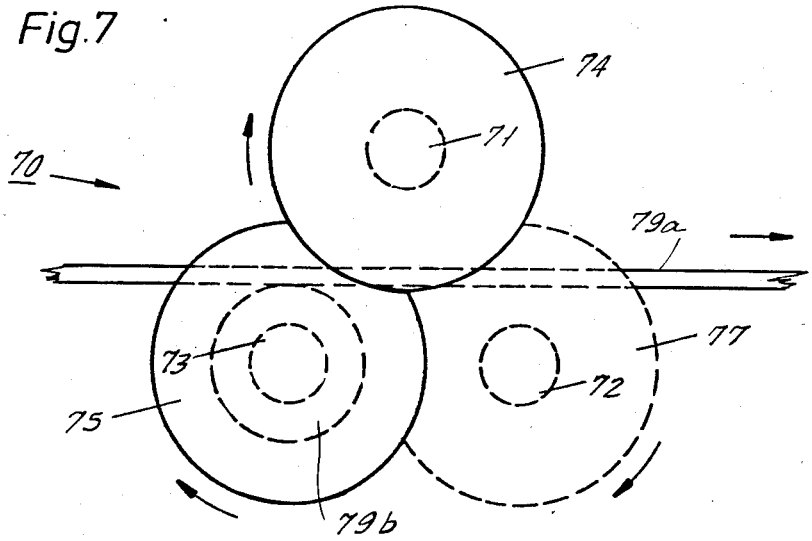
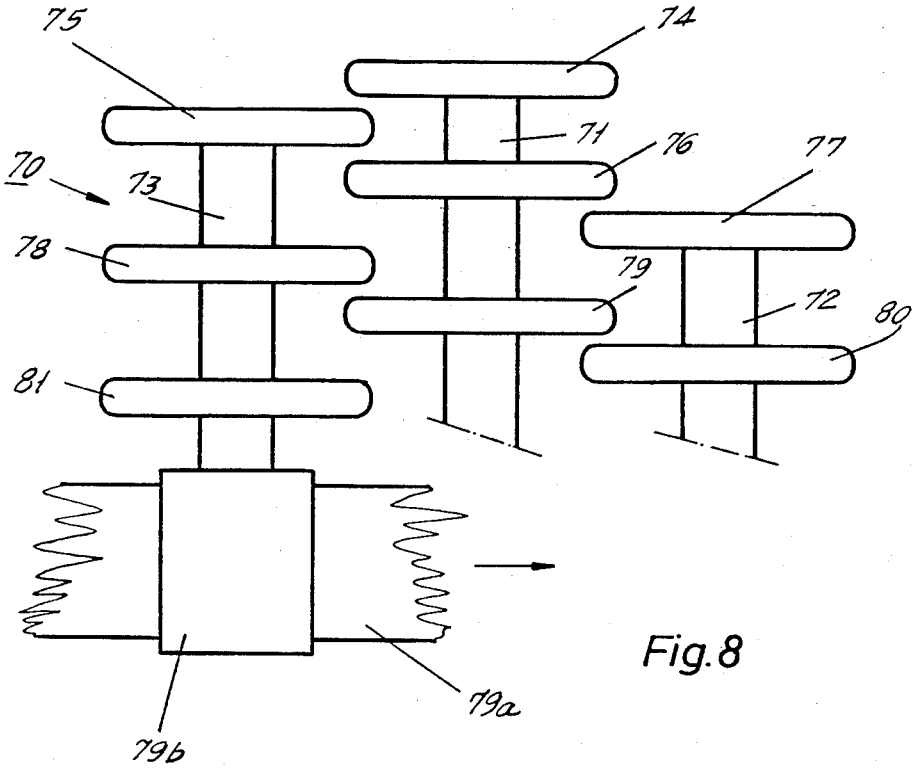
Fig.8

APPARATUS FOR THE FALSE TWISTING OF THREADS USING FRICTION DISKS

BACKGROUND OF THE INVENTION

1. Field of the Invention

The invention relates to a device for the false-twisting of thread by using friction disks. More specifically, the invention relates to defined combinations of disks for false-twisting thread.

2. Description of the Prior Art

German Application DE OS No. 25 27 216 describes an example of a disk combination with two shafts in which a thread guide disk must be arranged in a prescribed manner on one of the shafts. This arrangement of the disks is customary throughout the world and does not result in any problems when operated at the speeds of rotation and the withdrawal speeds used prior to the present time.

It is also conventional to operate with a plurality of thread guide disks on the thread inlet side, as shown in FAG publication No. DB 849, a publication of the assignee hereof. For clockwise rotating disks, each of the thread guide disks is strictly arranged in the clockwise direction from the preceding disk, for operating under certain given conditions, such as speed of rotation of the disks, nature of the disks, speeds of withdrawal and thread supplies. Such an arrangement has been used to obtain the required quality of final thread.

German Application DE OS No. 26 58 034 describes an inlet or outlet disk as a thread guide disk without indicating a definite arrangement of the disk within the unit. Furthermore, the curved contact surfaces in a heating body have direct contact with the thread. Traces of finishing agents are deposited on the curved contact surfaces, which necessarily contributes to agitating the movement of the thread. Up to now, these deposits of finishing agents have not contributed to any particular disturbances in the movement of the thread at the ordinary withdrawal speeds, which remain below a maximum of 600 meters per minute. At higher speeds, however, the deposits cause the thread to become very agitated.

The movement of the thread may be stabilized by thread guide disks arranged on the inlet and/or the outlet side of the pathway of the thread across the array of disks. Conventional disk combinations have as many as ten or more working disks for false-twisting the thread. In addition, there may be one, two or even three guide disks which are combined in series on the inlet side before the thread reaches the working disks. For clockwise rotating disks, each of the thread guide disks in the pathway of the thread across the disks, is always arranged in the clockwise direction of rotation from the preceding disk, as shown in FIGS. 1–3 hereto. As shown in FIG. 3, when one disk is used, it is mounted on shaft 3. When two disks are used as shown in FIG. 2, the first is mounted on shaft 2 and the second on shaft 3, clockwise from shaft 2. When three thread guide disks are used, as shown in FIG. 1, the third disk is arranged on shaft 1 clockwise from shaft 3. Only one thread guide disk is conventionally used on the thread outlet side.

Each combination of disks is described by an abbreviation. For example, if five working disks are used, the combinations described above could be described by the following abbreviations:

(A) 1-5-1
(B) 2-5-1
(C) 3-5-1

In each abbreviation, the first number indicates the number of thread guide disks on the inlet side, the second number the number of working disks on the outlet side of the inlet guide disks and the third number the number of thread guide disks on the outlet side of the working disks.

All of these combinations are used throughout the world for different threads and do not result in any particular difficulties with thread withdrawal speeds not exceeding 600 meters per minute.

Recently, there has been demand for higher withdrawal speeds, of 800 meters per minute and more. At these speeds, the thread movement can no longer be stabilized with only the thread guide disks described above. Although the thread can be caused to start up with one disk, its movement remains very agitated and this leads to frequent breaks in the thread. When two disks are used, it is barely possible to start up the thread, particularly if the working disks are made of a soft material. When three thread guide disks or working disks of soft material are used, it is impossible to start up the thread.

In all three cases indicated, the combination of guide disks results in agitation of the thread and does not allow the movement of the thread to stabilize. The thread movement cannot be stabilized even by using more than five working disks.

SUMMARY OF THE INVENTION

One object of the invention is, therefore, to provide a combination of disks arranged to permit high thread withdrawal speed while providing a suitable quality of thread.

This and other objects of the invention are achieved by providing a disk combination having the first of two guide disks on the same shaft as a first working disk on the inlet side of a thread false-twisting device. The disk combination guides the thread into and along a thread path for false-twisting between the three shafts of the device. The first inlet guide disk and the first working disk are on a first shaft, while the second inlet guide disk is on a second shaft and is located between the first guide disk and the first working disk. The second shaft may be positioned opposite the direction of rotation from the first shaft around the triangle defined by the three shfts. Toward the outlet from the inlet guide disks are a plurality of working disks, starting with the first working disk on the first shaft, for false-twisting the thread as it passes along the thread path. Each of the following working disks may be on the succeeding shaft positioned around the triangle from the preceding disk. The last of the working disks may be followed by an outlet guide disk for guiding the thread as it exits from the thread path.

The invention is based on the discovery that the arrangement of disks described above makes it possible to withdraw thread or yarn from nearly all supplies at a speed far greater than 600 meters per minute. As used herein, the word "thread" includes both thread and yarn, since the invention may be used for both. The disk combination of the invention avoids difficulties in the thread movement, especially if knotted thread is used. The first guide disk prevents these difficulties by bringing the entering thread past the second guide disk to the first working disk, which is rotating in the same direction on the same shaft as the first guide disk. Both the first guide disk and the first working disk may rotate to bring the thread inward, or toward the second guide disk. This arrangement provides an extremely gentle deflection of the thread at the inlet.

The working disks may have their contact surfaces comprising a soft material for contacting the thread, such as polyurethane. Such a soft material imparts greater twist to the thread, but the disk combination of the invention permits high withdrawal speeds even with such soft materials. Furthermore, the invention provides an additional economic advantage, because the gentle deflection of the entering thread leads to substantially longer useful lifetimes for the working disks.

The working disks may alternatively have a rigid or hard material for contacting the thread. For example, the body of each working disk may be rigid and may be coated with a hard layer of nickel containing diamond particles.

Another advantage of the disk combination of the invention is that it stabilizes the movement of the thread to eliminate agitation. This is beneficial because the deposits of finishing agent in the heating channels, described above, are greater at greater thread withdrawal speeds. At speeds greater than 600 meters per minute, these deposits would greatly agitate the thread movement, but the disk combination of the invention stabilizes the thread movement. Therefore, the thread is stabilized as it passes through the false-twisting device and is properly twisted.

Another advantage of the invention is that no more than five working disks are necessary for twisting nearly all threads and yarns. Previously, as many as ten working disks were necessary. With five working disks, either an S-twist or a Z-twist may be obtained. For an S-twist, the shafts rotate clockwise when viewed from the inlet. For a Z-twist, the shafts rotate counter-clockwise when viewed from the inlet. In either case, the working disks may be followed by an outlet guide disk for guiding the exiting thread.

Other objects, features and advantages of the invention will be apparent from the following description, together with the accompanying drawing and the appended claims.

BRIEF DESCRIPTION OF THE DRAWINGS

FIG. 7 shows in top view the disk combination of the invention for producing an S-twist, using only two inlet thread guide disks.

FIG. 8 shows in side view the complete disk combination for producing an S-twist with the elements shown widely spaced for illustrative purposes.

DETAILED DESCRIPTION OF PRIOR ART EMBODIMENTS

Figure 1:
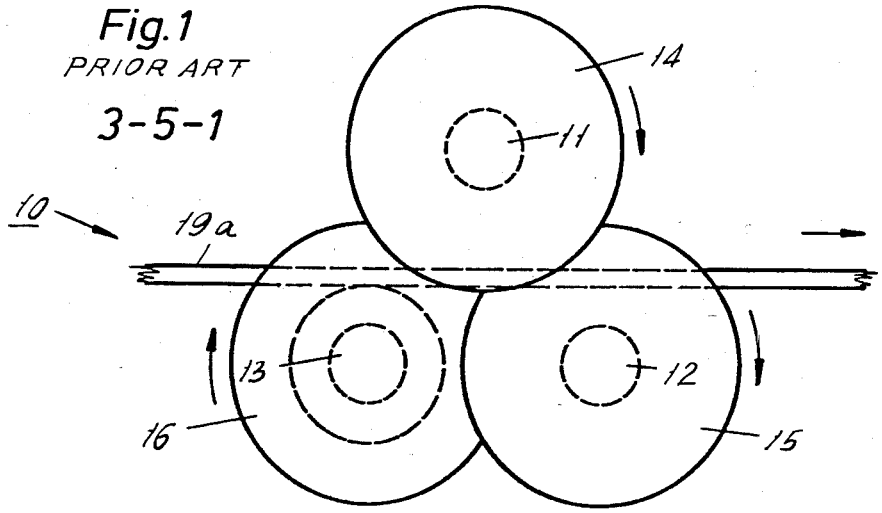
Fig. 1 PRIOR ART
FIG. 1 shows in top view the prior art combination of disks for producing an S-twist in a thread traveling from top to bottom using three inlet thread guide disks.
Figure 2:
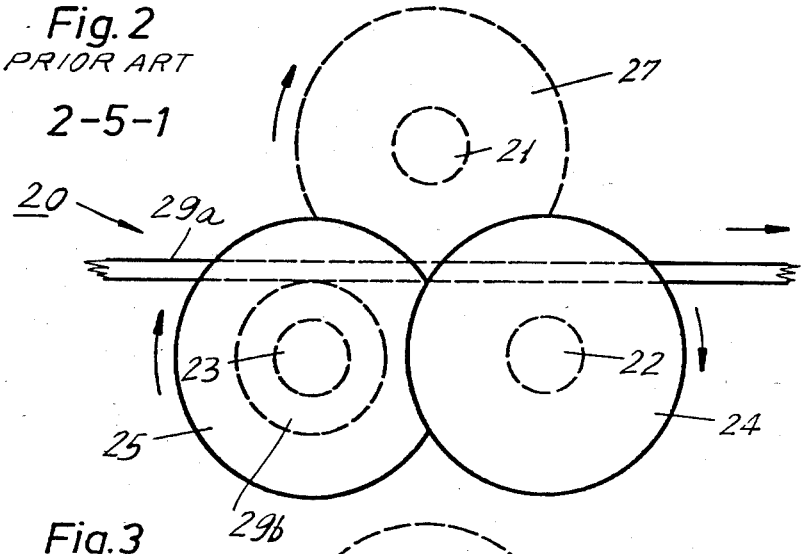
Fig. 2 PRIOR ART
FIG. 2 shows in top view the prior art combination using two inlet thread guide disks.
Figure 3:
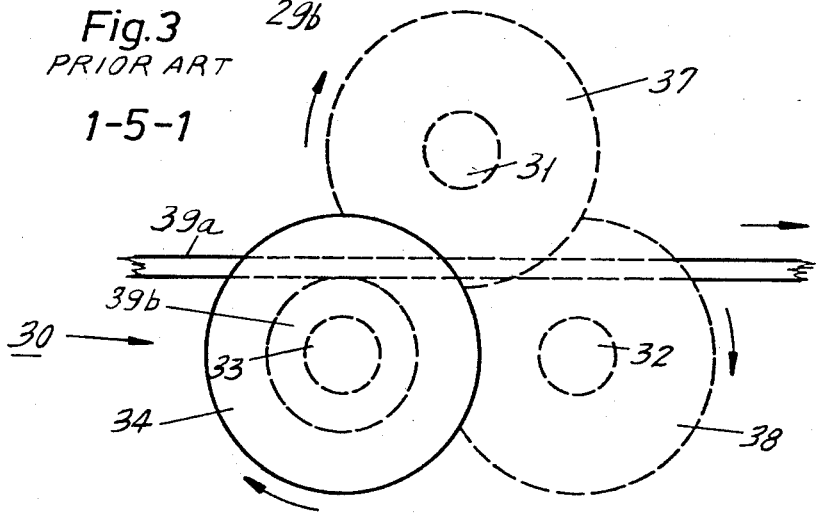
Fig. 3 PRIOR ART
FIG. 3 shows in top view the prior art combination using one inlet thread guide disk.
Figure 4:
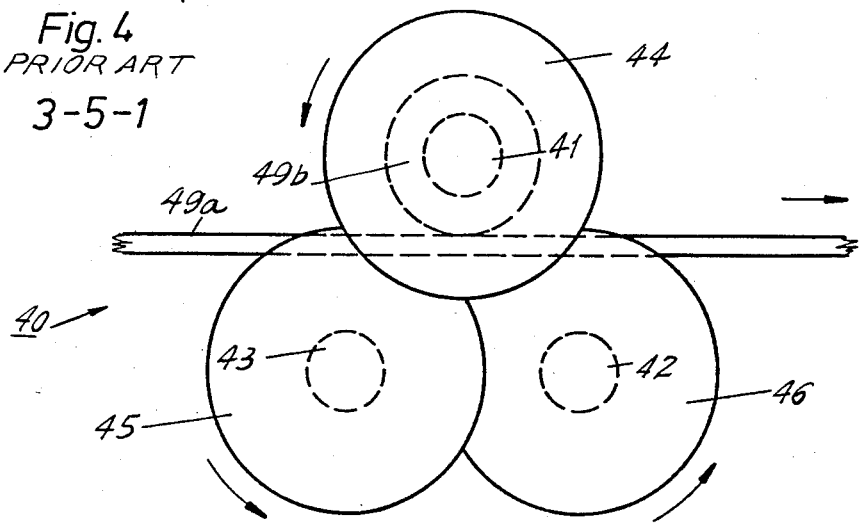
Fig. 4 PRIOR ART
FIGS. 4, 5 and 6 show in top view the prior art combinations of disks equivalent to those in FIGS. 1 to 3, respectively, for producing a Z-twist.
Figure 5:
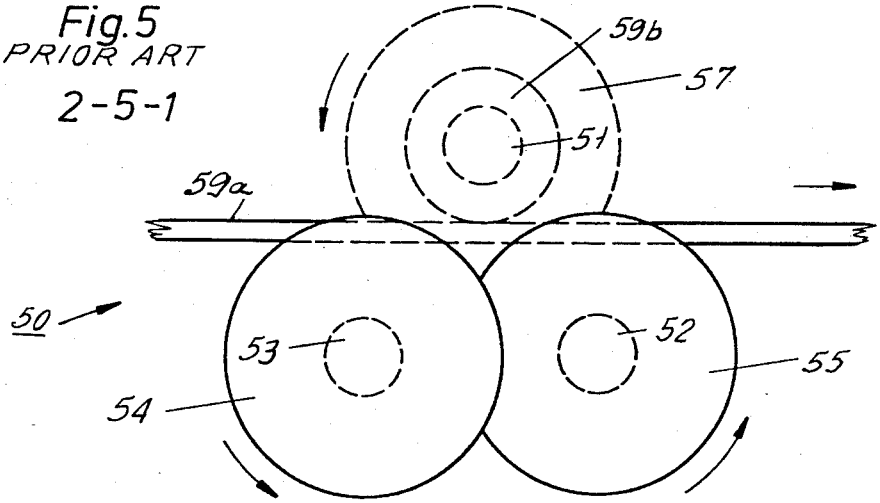
Fig. 5 PRIOR ART
Figure 6:
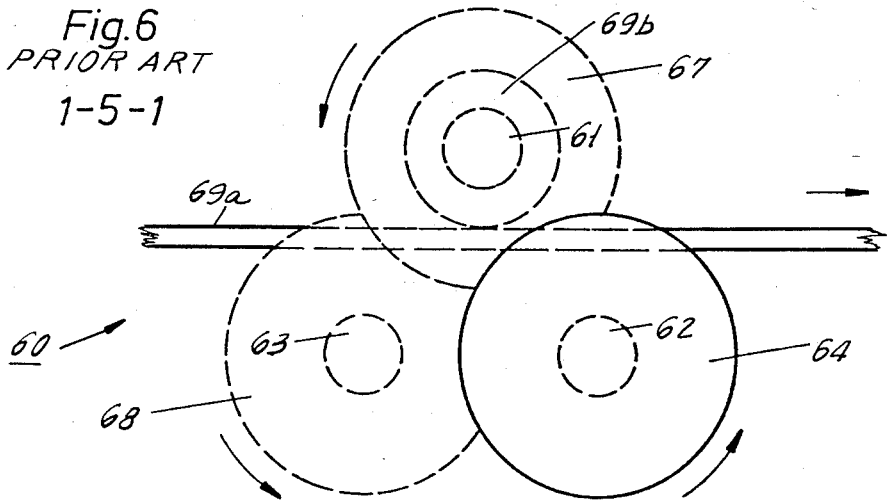
Fig. 6 PRIOR ART

The general operation of inlet guide disks for thread false-twisting devices may be understood from FIGS. 1–6, which show several prior art disk combinations. FIGS. 1–3 show disk combinations 10, 20, 30 for producing an S-twist, while FIGS. 4–6 show combinations 40, 50, 60 for producing a Z-twist. As the disks are viewed from the top, only the circular profile of the upper disk on each shaft is shown. The guide disks are shown in solid profile, while the working disks are in dashed line profile. As shown, each disk rotates in a clockwise direction as viewed from the inlet end or top. Also shown in dashed lines are the shafts and pulleys that are used to drive the shafts.

FIG. 1 shows a conventional 3-5-1 disk combination 10 for producing an S-twist. The three shafts 11, 12 and 13 support respective guide disks 14, 15 and 16. As shown in FIG. 1, the thread entering from above first encounters inlet guide disk 14, then inlet guide disk 15, and finally inlet guide disk 16 before it reaches the working disks (not shown). The thread passes between the disks in the central area.

FIG. 2 similarly shows a conventional 2-5-1 disk combination for producing an S-twist. The shafts 21, 22 and 23 support respective disks 27, 24 and 25. The entering thread first encounters inlet guide disk 24, then inlet guide disk 25, and then the thread goes to the first working disk 27. As in FIG. 1, the direction of rotation of the disks is clockwise as viewed from the inlet end or top. Therefore, in relation to the triangle whose corners are defined by the three shafts 21, 22 and 23, the second inlet guide disk 25 is positioned in the clockwise rotational direction from the first guide disk 24, while the first working disk 27 is in turn positioned in the clockwise rotational direction from the second guide disk 25. As a result, the first guide disk 24 and the first working disk 27 are on different shafts.

FIG. 3 shows a conventional 1-5-1 disk combination for producing an S-twist. Here, shafts 31, 32 and 33 support respective disks 37, 38 and 34. In this case, the only guide disk is inlet thread guide disk 34. After the thread passes guide disk 34, it meets first working disk 37 and then meets second working disk 38. As can be seen from FIG. 3, first working disk 37 is positioned in the clockwise direction of rotation from guide disk 34, and second working disk 38 is in turn positioned in the clockwise rotational direction from first working disk 37.

As can be seen from FIGS. 1–3, shafts 12, 23 and 33 may also hold respective drive whorls **19*b*, 29*b* and 39*b*. These whorls may each be driven by a respective belt 19*a*, 29*a* and 39*a*** for producing the clockwise rotation, as shown. The other shafts are belt driven by the whorl carrying shaft.

In contrast to FIGS. 1–3, FIGS. 4–6 show conventional disk combinations for producing Z-twists. As can be seen by comparing FIGS. 4–6 with FIGS. 1–3, the direction of disk rotation is counter-clockwise, as viewed from the inlet or top end, rather than clockwise.

FIG. 4 shows a conventional 3-5-1 combination for producing a Z-twist. Shafts 41, 42 and 43 support respective disks 44, 46 and 45. The entering thread first encounters first inlet thread guide disk 44, then second inlet thread guide disk 45, and finally third inlet guide disk 46, before reaching the working disks. As can be seen by comparing FIG. 4 with FIG. 1, the three guide disks are arranged in each case so that, in relation to the triangle defined by the shafts, the second guide disk is positioned in the direction of rotation from the first guide disk and the third guide disk is positioned in the directiion of rotation from the second guide disk. This relationship holds even though the directions of rotation are different for the two conventional combinations, being clockwise in FIG. 1 and counter-clockwise in FIG. 4.

FIG. 5 shows a conventional 2-5-1 disk combination for producing a Z-twist. Shafts 51, 52 and 53 support respective disks 57, 55 and 54. The entering thread first contacts first inlet guide disk 54, then second inlet guide disk 55. From guide disk 55, the thread proceeds to first working disk 57. In this arrangement, the second guide disk 55 is positioned in the counter-clockwise direction of rotation from the first guide disk 54 while the first working disk 57 is positioned in the direction of rotation from the second guide disk 55. As a result, the first guide disk 54 and the first working disk 57 are on different shafts.

FIG. 6 shows a conventional 1-5-1 disk combination for producing a Z-twist. Shafts 61, 62 and 63 support respective disks 67, 64, and 68. The entering thread first contacts first inlet guide disk 64, from which it passes to first working disk 67 and then to second working disk 68. Here again, the first working disk 67 is positioned in the counter-clockwise direction of rotation from the guide disk 64 and the second working disk 68 is positioned in the direction of rotation from the first working disk 67.

FIGS. 4–6 also show shafts 41, 51 and 61 holding respective drive whorls **49*b*, 59*b* and 69*b*. These whorls 49*b*, 59*b* and 69*b* may be driven by respective belts 49*a*, 59*a* and 69*a* for causing shafts 41, 51 and 61** to rotate in the counter-clockwise direction.

DETAILED DESCRIPTION OF PREFERRED EMBODIMENTS

Figure 9:
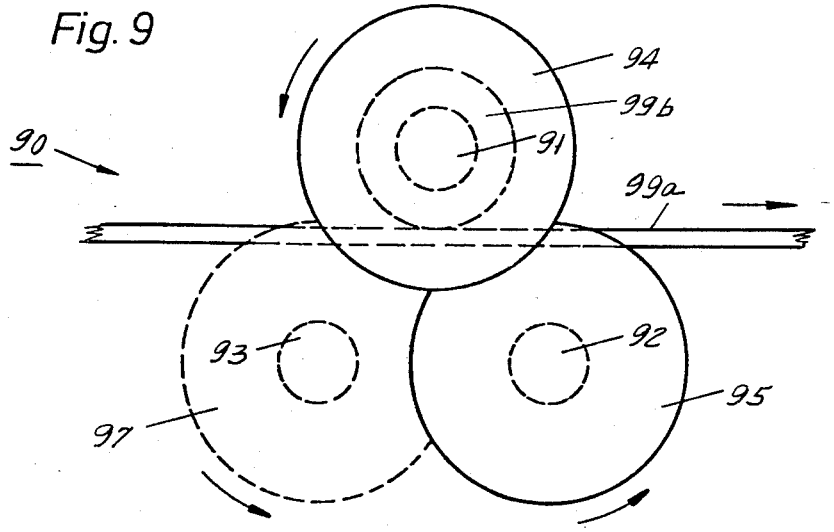
FIG. 9 shows in top view the disk combination of the invention for producing a Z-twist.
Figure 10:
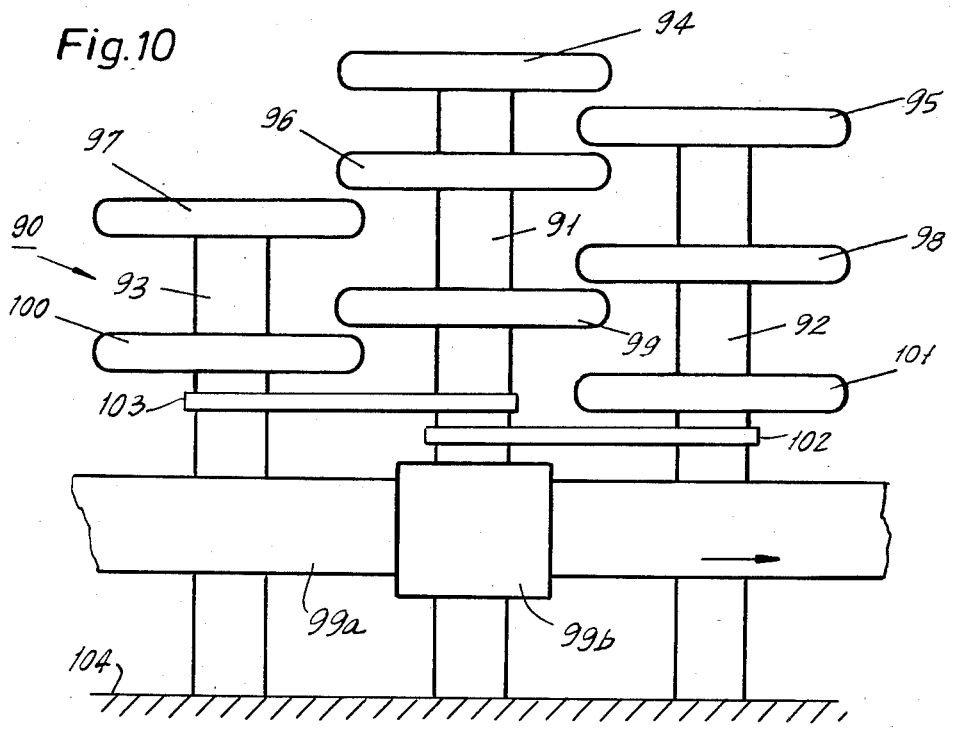
FIG. 10 shows in side view the complete disk combination for producing a Z-twist with the elements shown widely spaced for illustrative purposes.

The disk combinations of the invention can be understood from FIGS. 7–10. FIGS. 7–8 show a disk combination for producing an S-twist, while FIGS. 9–10 show a disk combination for producing a Z-twist. In both cases, however, a 2-5-1 disk combination is provided, with the first working disk and the first inlet guide disk on the same shaft. Between the first inlet guide disk and the first working disk is the second inlet guide disk on another shaft, which may be positioned in a direction opposite the rotational direction from the first inlet guide disk.

FIG. 7 shows the S-twist disk combination 70 of the invention. Shafts 71, 72 and 73 support respective disks 74, 77 and 75. First and second inlet thread guide disks 74 and 75 are shown in solid profile. First working disk 76 cannot be seen because it is on shaft 71 beneath first guide disk 74. Second working disk 77, however, is positioned in the clockwise direction of rotation from first working disk 76, as shown. Belt **79*a* drives whorl 79*b* on shaft 73**.

FIG. 8 shows the S-twist disk combination 70 of FIG. 7 in front view, with the parts somewhat separated for clarity. As shown in FIG. 8, the first disk at the inlet (top) side of the false-twisting device is first inlet guide disk 74 on shaft 71. After the thread encounters disk 74, it passes to second inlet guide disk 75 on shaft 73. From there it psses back to first working disk 76, also mounted on shaft 71, which is the first in a series of five working disks 76, 77, 78, 79 and 80, each of which is positioned on the next succeeding shaft around the triangle defined by the shafts from the preceding disk. In FIG. 8, each working disk is positioned in the clockwise direction of rotation around the triangle from the preceding disk. After the last working disk 80, outlet guide disk 81 on shaft 73 is also positioned in the direction of rotation from the preceding working disk, which is the last working disk 80. Belt **79*a* drives whorl 79*b***, as shown.

As discussed above, the invention is based on the discovery that this disk combination permits a high speed of thread withdrawal from the thread supply over a broad range of types of thread. In passing from first guide disk 74 to first working disk 76 on the same shaft, the thread is gently deflected by second guide disk 75 on another shaft. This deflection, however, does not interfere with the rapid withdrawal of the thread, and instead serves to stabilize the thread movement.

FIG. 9 shows the Z-twist disk combination of the invention. Shafts 91, 92 and 93 support respective disks 94, 95 and 97. Entering thread first contacts first inlet guide disk 94, and then contacts second inlet guide disk 95. The thread then proceeds to first working disk 96, which is beneath first guide disk 94 on shaft 91. Then the thread proceeds to second working disk 97. As described in relation to FIG. 7, the second guide disk 95 is positioned on shaft 92 in a direction opposite the rotational direction from the first guide disk 94.

FIG. 10 shows the Z-twist disk combinaion 90 of FIG. 9 in a front view similar to FIG. 8. The entering thread encounters first inlet guide disk 94, then second inlet guide disk 95. From guide disk 95, the thread proceeds past five working disks 96, 97, 98, 99 and 100, each of which is positioned on the next succeeding shaft around the triangle defined by the shafts from the preceding disk. In FIG. 10, each working disk is positioned in the counter-clockwise direction of rotation around the triangle from the preceding disk. In addition, outlet guide disk 101 is positioned on shaft 92 in the direction of rotation from the preceding disk, which is the last working disk 100. Shaft 91 is driven by belt **99*a* through whorl 99*b*. FIG. 10 also shows more fully how the shafts may be connected by drive belts 102 and 103, and how shafts 91, 92 and 93 are mounted on frame 104**. This arrangement is merely illustrative, however, as the shafts could be rotatably mounted and interconnected in many ways.

As discussed above, the Z-twist disk combination 90 of the invention, like the S-twist disk combination 70 shown in FIGS. 7 and 8, includes the basic combination of a first inlet guide disk on the same shaft as the first working disk. Between them is a second inlet guide disk, which may be positioned in a direction opposite the rotational direction from the first guide disk. After the first working disk are additional working disks, each positioned on the next succeeding shaft around the triangle defined by the shafts from the preceding disk.

Figure 11:
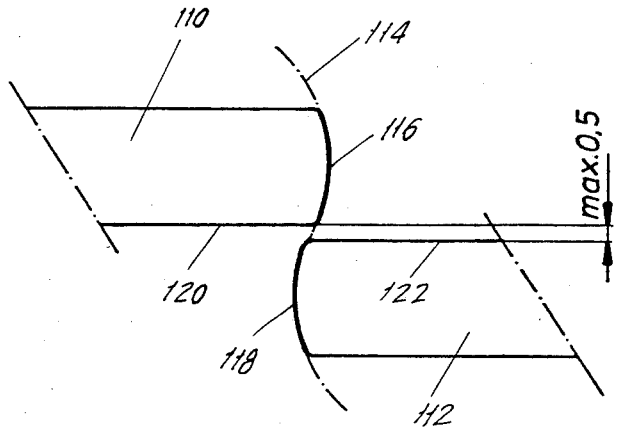
FIG. 11 shows a partial profile of two adjacent disks, showing the maximum disk spacing as well as the thread transfer path.

FIG. 11 shows in greater detail the relationship between two adjacent disks 110 and 112 of the invention. As shown, a thread 114 passes across the slightly rounded edge 116 of disk 110 and then across the slightly rounded edge 118 of disk 112. The disks 110 and 112 have adjacent respective sides 120 and 122, both of which are flat. These adjacent sides 120 and 122 are spaced apart by a distance which preferably does not exceed 0.5 millimeters. In addition, the edges 116 and 118 which contact thread 114 may have any appropriate texture. Specifically, if disks 110 and 112 are working disks, their edges may each be a soft material, such as polyurethane. When the disks of such a material are used, their lives are lengthened by the invention, because the thread is easily threaded through the false-twisting until and because of the stable operation at high speeds of withdrawal. On the other hand, disks 110 and 112 may consist of a rigid material, coated with a hard substance such as nickel containing diamond particles.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A device for false-twisting thread comprising:

three rotatable parallel shafts, each shaft defining a respective corner of a triangle, each of the shafts having an inlet end disposed in an inlet direction for defining an inlet for entering thread and an outlet end disposed in an outlet direction opposite the inlet direction for defining an outlet for exiting thread; the shafts defining a thread path between them for passing thread from the inlet to the outlet;

drive means for rotating the shafts;

a first inlet guide disk on a first one of the shafts at the inlet end thereof for rotating with the first shaft for guiding the entering thread into the thread path;

a second inlet guide disk on a second one of the shafts at the inlet end thereof for rotating with the second shaft and positioned in the outlet direction from the first guide disk for guiding the thread; and a first working disk on the first shaft for rotating therewith and positioned in the outlet direction from the second guide disk for receiving the thread from the second guide disk and for false-twisting the thread as the thread passes along the thread path.

2. The device of claim 1 further comprising a plurality of working disks for false-twisting the thread as the thread passes along the thread path, the plurality of working disks including the first working disk, each of the working disks being on one of the shafts for rotating therewith, each of the working disks other than the first working disk being positioned in the outlet direction from a preceding one of the working disks for receiving the thread from the preceding working disk.

3. The device of claim 2 in which the plurality of working disks comprises five of the working disks, the five working disks including the first working disk and a last one of the working disks, the last one of the working disks being positioned in the outlet direction from the others of the five working disks, the device further comprising an outlet guide disk positioned in the outlet direction from the last working disk for guiding the exiting thread.

4. The device of claim 2 in which each of the working disks other than the first working disk is on the next succeeding shaft around the triangle defined by the shafts from the preceding work disk.

5. The device of claim 4 in which the drive means is for rotating all three of the shafts in a rotational direction, each of the working disks other than the first working disk being on one of the shafts positioned in the rotational direction around the triangle defined by the shafts from the preceding working disk.

6. The device of claim 5 in which the rotational direction of the shafts is clockwise when viewed from the inlet direction, the device imparting an S-twist to the thread.

7. The device of claim 5 in which the rotational direction of the shafts is counter-clockwise when viewed from the inlet direction, the device inparting a Z-twist to the thread.

8. The device of claim 1 in which the drive means is for rotating all three of the shafts in a rotational direction, the second shaft being positioned in a direction opposite the rotational direction around the triangle defined by the shafts from the first shaft, the first inlet guide disk and first working disk thereby rotating inward toward the second inlet guide disk along the thread path for gently deflecting the thread.

9. The device of claim 1 in which the first working disk comprises a soft material for contacting the thread.

10. The device of claim 9 in which the soft material is polyurethane.

11. The device of claim 1 in which the first working disk comprises a hard material for contacting the thread.

12. The device of claim 11 in which the hard material is a coating of nickel comprising diamond particles.

13. The device of claim 1 in which each disk is spaced from each adjacent disk by a distance not greater than 0.5 millimeters.

* * * * *